US008452495B2

(12) United States Patent
Park et al.

(10) Patent No.: US 8,452,495 B2
(45) Date of Patent: May 28, 2013

(54) EMERGENCY ENGINE RPM CONTROL APPARATUS FOR HEAVY CONSTRUCTION EQUIPMENT

(75) Inventors: Duck Woo Park, Incheon (KR); Hong Cheol Yun, Incheon (KR)

(73) Assignee: Doosan Infracore Co., Ltd., Incheon (KR)

( * ) Notice: Subject to any disclaimer, the term of this patent is extended or adjusted under 35 U.S.C. 154(b) by 70 days.

(21) Appl. No.: 13/142,036

(22) PCT Filed: Dec. 22, 2009

(86) PCT No.: PCT/KR2009/007690

§ 371 (c)(1), (2), (4) Date: Jun. 24, 2011

(87) PCT Pub. No.: WO2010/074494

PCT Pub. Date: Jul. 1, 2010

(65) Prior Publication Data

US 2011/0264338 A1 Oct. 27, 2011

(30) Foreign Application Priority Data

Dec. 24, 2008 (KR) ..... 10-2008-0133589

(51) Int. Cl.
*G06F 7/70* (2006.01)

(52) U.S. Cl.
USPC ..... 701/50

(58) Field of Classification Search
USPC ..... 701/50, 54, 29.1, 29.2
See application file for complete search history.

(56) References Cited

U.S. PATENT DOCUMENTS 6,098,322 A * 8/2000 Tozawa et al. ..... 37/414
2010/0094515 A1* 4/2010 Shirao et al. ..... 701/50

FOREIGN PATENT DOCUMENTS

JP 11-061884 3/1999
JP 2000-303499 10/2000
KR 1020030004695 1/2003

OTHER PUBLICATIONS

International Search Report written in Korean PCT/KR2009/007690 filed Dec. 22, 2009; 3 pages.

* cited by examiner

*Primary Examiner* — Kim T Nguyen
(74) *Attorney, Agent, or Firm* — John D. Veldhuis-Kroeze; Westman, Champlin & Kelly, P.A.

(57) ABSTRACT

The present disclosure relates to an apparatus for contingency controlling an engine rotational speed of a heavy construction equipment, which is capable of contingency controlling the speed of an engine when a controller of the heavy construction equipment such as an excavator does not operate normally. The apparatus for contingency controlling an engine rotational speed including a machine control unit generating a driving signal to control an operation of the engine by transferring a control value received from a control dial to an engine control unit may include: an instrument panel electrically connected with the engine control unit and allowing an operator to select and control a desired engine rotational speed because a control algorithm for the engine rotational speed is made into a database; and a connection switch electrically connecting the instrument panel and the engine control unit when the control dial or the machine control unit does not operate normally.

8 Claims, 6 Drawing Sheets

EMERGENCY ENGINE RPM CONTROL APPARATUS FOR HEAVY CONSTRUCTION EQUIPMENT

CROSS-REFERENCE TO RELATED APPLICATION

This Application is a Section 371 National Stage Application of International Application No. PCT/KR2009/007690, filed 22 Dec. 2009 and published as WO/2010/074494 on 1 Jul. 2010, in Korean, the contents of which are hereby incorporated by reference in their entirety.

FIELD OF THE DISCLOSURE

The present disclosure relates to an apparatus for controlling an engine rotational speed, and more particularly, to an apparatus for contingency controlling an engine rotational speed of a heavy construction equipment capable of contingency controlling the speed of an engine when a controller of the heavy construction equipment such as an excavator does not operate normally.

BACKGROUND OF THE DISCLOSURE

In general, a known engine rotational speed controlling apparatus used to control an engine rotational speed of a heavy construction equipment such as an excavator is shown in FIG. 1.

According to the known engine rotational speed controlling apparatus, an operator controls a control dial 1 manually in order to control a rotational speed of an engine 4.

The control dial 1 is electrically connected with an equipment control unit (MCU) 2 and an engine control unit (ECU) 3 therein to transfer a value controlled by the operator to the engine 4.

In this case, the known machine control unit 2 wholly controls various driving devices required to drive the construction equipment and the engine control unit 3 controls driving of the engine among various driving devices of the construction equipment. Further, the control dial 1 converts a value inputted by the operator into a voltage value and transfers the converted voltage value to the machine control unit 2.

Accordingly, in the known engine rotational speed controlling apparatus, when the operator controls the control dial 1, the machine control unit 2 gives a command to the engine control unit 3 by receiving the corresponding voltage value and controls the engine rotational speed as high as a value controlling the control dial 1 to drive the engine 4.

However, in the known engine rotational speed controlling apparatus, when the control dial 1 or the machine control unit 2 are defective, an operation for the engine rotational speed cannot be normally controlled, and as a result, there is inconvenience in that the operator cannot control until the operator changes the control dial 1 or the machine control unit 2.

The discussion above is merely provided for general background information and is not intended to be used as an aid in determining the scope of the claimed subject matter.

SUMMARY

This summary and the abstract are provided to introduce a selection of concepts in a simplified form that are further described below in the Detailed Description. The summary and the abstract are not intended to identify key features or essential features of the claimed subject matter, nor is it intended to be used as an aid in determining the scope of the claimed subject matter.

The present disclosure is contrived to solve the problems and an object of the present disclosure is to provide an apparatus for contingency controlling an engine rotational speed of a heavy construction equipment capable of contingency controlling the speed of an engine when a controller such as a machine control unit or a dial does not operate normally in the heavy construction equipment.

In order to achieve the object, an apparatus for contingency controlling an engine rotational speed of a heavy construction equipment according to the present disclosure including a control dial for controlling a rotational speed of an engine and a machine control unit generating a driving signal to control an operation of the engine by transferring a control value received from the control dial to an engine control unit includes: an instrument panel electrically connected with the engine control unit and allowing an operator to select and control a desired engine rotational speed because a control algorithm for the engine rotational speed is made into a database; and a connection switch electrically connecting the instrument panel and the engine control unit when the control dial or the machine control unit does not operate normally.

According to the exemplary embodiment of the present disclosure, the instrument panel may include: a storage previously storing the control algorithm for the engine rotational speed; an input controller allowing the operator to select and control the desired engine rotational speed; and a controller reading a value corresponding to a predetermined control signal from the storage when receiving the predetermined control signal through the input controller, and outputting the read value to the engine control unit.

According to the exemplary embodiment of the present disclosure, the engine control unit may control the engine rotational speed through the control dial and the instrument panel in a normal state and in addition, control the engine rotational speed through a control signal finally controlled between the control dial and the instrument panel and control the engine rotational speed only in the instrument panel when the connection switch is abnormally controlled.

According to the exemplary embodiment of the present disclosure, the connection switch may automatically connect the instrument panel and the engine control unit when any one of the machine control unit and the dial is erroneous.

According to the exemplary embodiment of the present disclosure, the connection switch may be additionally provided in the instrument panel or an operating room to be switched by operator's selection.

According to another exemplary embodiment of the present disclosure, the instrument panel may be additionally connected even to the machine control unit, the connection switch may be installed between the machine control unit and the engine control unit and disconnect the machine control unit and the engine control unit from each other and connect only the instrument panel and the engine control unit to each other when the machine control unit and the dial are erroneous, and the engine control unit may be driven based on a signal received from the machine control unit when the engine control unit is connected to both the machine control unit and the instrument panel and driven based on a signal received from the instrument panel when the engine control unit is connected with only the instrument panel.

In this case, the connection switch may automatically connect the instrument panel and the engine control unit when any one of the machine control unit and the dial is erroneous.

According to another exemplary embodiment of the present disclosure, the connection switch may be additionally provided in the instrument panel or an operating room to be switched by operator's selection.

As described above, according to the present disclosure, when a controller of a heavy construction equipment does not operate normally, an operator can contingency operate an engine by using an electronic instrument panel, and as a result, stability of the heavy construction equipment can be ensured.

DETAILED DESCRIPTION

Hereinafter, an apparatus for contingency controlling an engine rotational speed of a heavy construction equipment according to an exemplary embodiment of the present disclosure will be described in detail with reference to the accompanying drawings.

Figure 1:
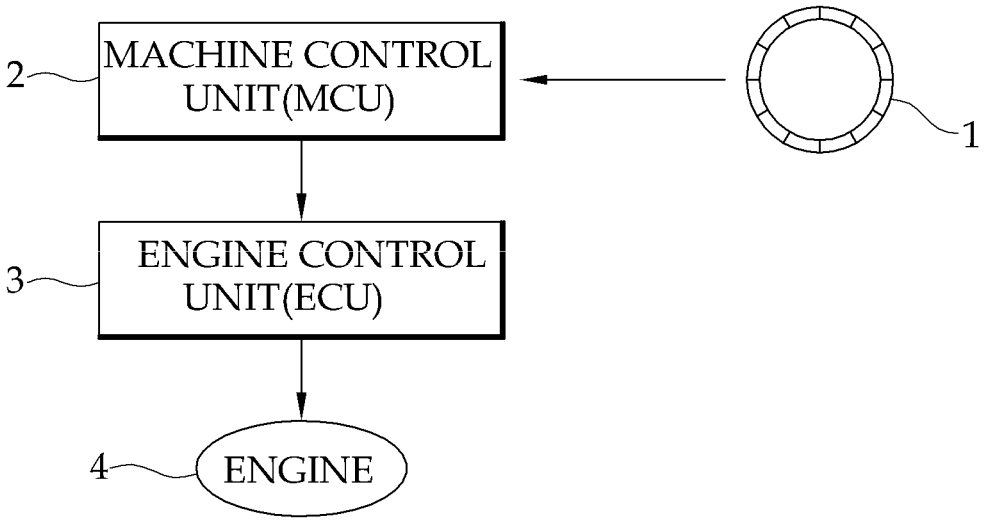
(Prior Art) Figure 1
FIG. 1 is a configuration diagram showing a known engine rotational speed controlling apparatus of a heavy construction equipment.
Figure 2:
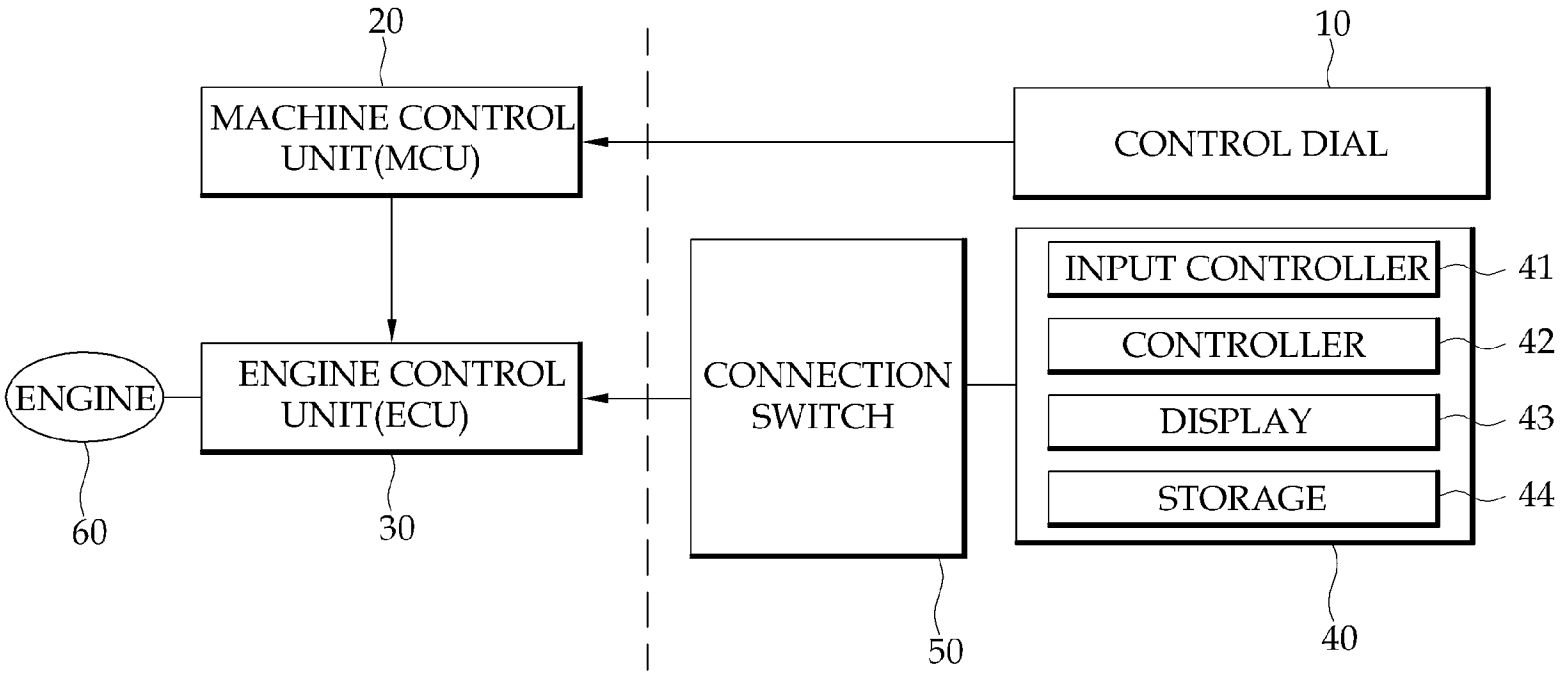
FIG. 2 is a configuration diagram showing an apparatus for contingency controlling an engine rotational speed of a heavy construction equipment according to an exemplary embodiment of the present disclosure.
Figure 3:
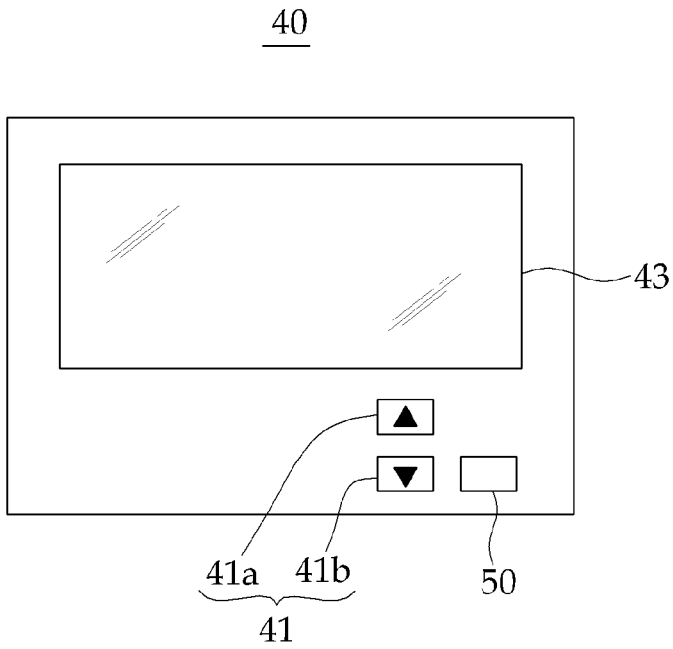
FIG. 3 is an example of an instrument panel shown in FIG. 2.
Figure 4:
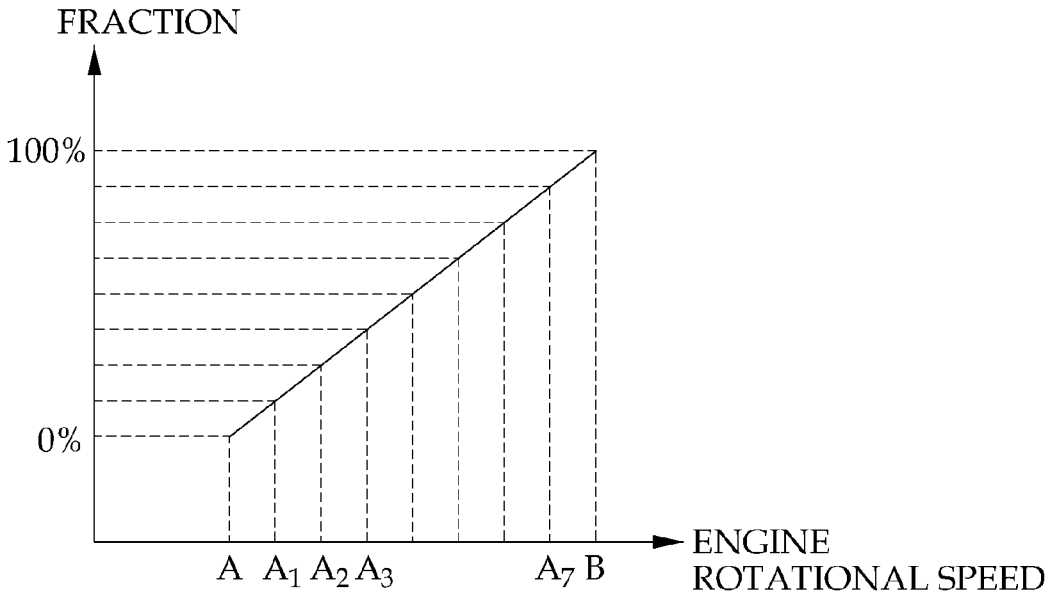
FIG. 4 is a graph for describing a control algorithm of an engine rotational speed of a heavy construction equipment according to an exemplary embodiment of the present disclosure.

FIG. 2 is a configuration diagram showing an apparatus for contingency controlling an engine rotational speed of a heavy construction equipment according to an exemplary embodiment of the present disclosure, FIG. 3 is an example of an instrument panel shown in FIG. 2, and FIG. 4 is a graph for describing a control algorithm of an engine rotational speed of a heavy construction equipment according to an exemplary embodiment of the present disclosure.

The engine rotational speed controlling apparatus of the heavy construction equipment described in the exemplary embodiment has a basic configuration in which a machine control unit receives a value inputted from an external control dial to control the engine rotational speed.

As a result, the engine rotations speed controlling apparatus of the heavy construction equipment according to the exemplary embodiment of the present disclosure may be configured to include a control dial 10 which can be manually controlled by an operator, a machine control unit (MCU) 20, an engine control unit (ECU) 30, an instrument panel 40, a connection switch 50, and an engine 60, as shown in FIG. 2.

The control dial 10 is additionally provided in an operating room of the heavy construction equipment so as for the operator to control a desired engine rotational speed. The control dial 10 may be provided in a rotary lever type as shown in the figure and may set the corresponding engine rotational speed to 1000 rpm, 1500 rpm, 2000 rpm, 2500 rpm, and the like according to a rotational angle. The set values are converted into voltage values and applied to the machine control unit 20.

In this case, the engine rotational speed which can be set through the control dial 10 may increase and decrease by a predetermined unit. For example, the rotational engine speed may increase or decrease from 1000 rpm to 1500 rpm by the unit of 500 rpm and the set unit may be variously modified and changed by the unit of the minimum 1 rpm.

The machine control unit 20 controls all various controllers that control various driving devices for driving the heavy construction equipment.

In particular, the machine control unit 20 according to the exemplary embodiment of the present disclosure receives the value set through the control dial 10 and transfers the received value to the engine control unit 30. In this case, the value received from the control dial 10 becomes as the voltage value acquired by converting the value set through the control dial 10. Accordingly, the corresponding engine control unit 30 is controlled in order to drive the engine 60 with the voltage value.

The engine control unit 30 generates a driving control signal for driving the engine 60 on the basis of a set value received from the machine control unit 20 or instrument panel 40.

The connection switch 50 serves to electrically connect the instrument panel 40 and the engine control unit 30 to each other according to a switching operation when the control dial 10 or the machine control unit 20 does not operate normally. The connection switch 50 may operate by a selection control of the operator and can be configured to operate when the machine control unit 20 and the control dial 10 are erroneous. In the former case, the connection switch 50 is provided in the instrument panel 40 in a button type or additionally provided in the operating room to operate according to selection or not of the operator as shown in FIG. 3. In the latter case, the connection switch 50 requires an additional component capable of detecting errors of the machine control unit 20 and the control dial 10.

The instrument panel 40 according to the exemplary embodiment of the present disclosure is provided outside the heavy construction equipment like the control dial 10 to provide an interface capable of operating the engine rotational speed normally.

The instrument panel 40 is electrically connected with the engine control unit 30 according to the operation of the connection switch 50 as shown in FIG. 2 and a control algorithm for the engine rotational speed is made into a database to enable the operator to select and control the desired engine rotational speed.

Specifically, the instrument panel 40 may include an input controller 41 with control buttons (41*a* and 41*b* of FIG. 3) that allow the operator to select and control the desired engine rotational speed, a storage 44 previously storing the control algorithm for the engine rotational speed, a controller 42 that reads an engine rotational speed value corresponding to a predetermined control signal from the storage 44 and outputs the read value when the predetermined control signal is inputted through the input controller 41, and a display 43 visually displaying the engine rotational speed value which the operator sets through the input controller 41, a presently set engine rotational speed value, and the like.

Herein, the control algorithm for the engine rotational speed is constructed based on a linear graph shown in FIG. 4.

The linear graph shows the engine rotational speed value with parts. In this linear graph, the minimum and maximum engine rotational speeds A and B which can be controlled in operating the engine exist and stepwise engine rotational speed values A1 to A7 classified by the unit of a predetermined fraction within a range between the minimum and maximum engine rotational speeds A and B are previously set. Accordingly, when the operator controls the engine rotational speed through the input control unit 41, there is used an algorithm scheme to mach the stepwise engine rotational speed values A1 to A7 corresponding to the corresponding control values.

For example, it is assumed that the controllable engine rotational speed is in the range of 500 rpm to 1500 rpm. Therefore, the minimum engine rotational speed A is 500 rpm and the maximum engine rotational speed B is 1500 rpm. When the range therebetween matches 0 to 100% and the fraction is set to 10%, an algorithm in which the following values A1, A2, A3, . . . of the minimum engine rotational speed A are 600 rpm, 700 rpm, 800 rpm, (omitted), 1300 rpm, 1400 rpm may be applied.

Accordingly, when the operator controls the engine rotational speed by using the input controller 41 with the up/down buttons 41*a* and 41*b* shown in FIG. 3, the controller 42 reads an engine rotational speed value increased or decreased by a predetermined fraction from the storage 44 every time the operator controls the up and buttons 41*a* and 41*b* once and outputs the read value. The outputted engine rotational speed value is transferred directly to the engine control unit 30 to normally control the driving of the engine.

An operating method of the apparatus for contingency controlling the engine rotational speed according to the exemplary embodiment of the present disclosure configured as above will be described below.

The operator controls the engine rotational speed by using the control dial 10 in normal times and when the controller of the heavy construction equipment, such as the control dial 10 or the machine control unit 20 does not operate normally, the operator operates the connection switch 50 to electrically connect the instrument panel 40 and the engine control unit 30 to each other.

The control algorithm for the engine rotational speed is previously constructed in the instrument panel 40. Therefore, when the operator controls the engine rotational speed through the input controller 41, the instrument panel 40 outputs the corresponding engine rotational speed value every time the operator operates the control buttons of the input controller 41 once on the basis of the algorithm.

In this case, the outputted engine rotational speed value is applied to the electrically connected engine control unit 30, and as a result, the engine 60 can be normally controlled by using the instrument panel 40 in contingency.

Figure 5:
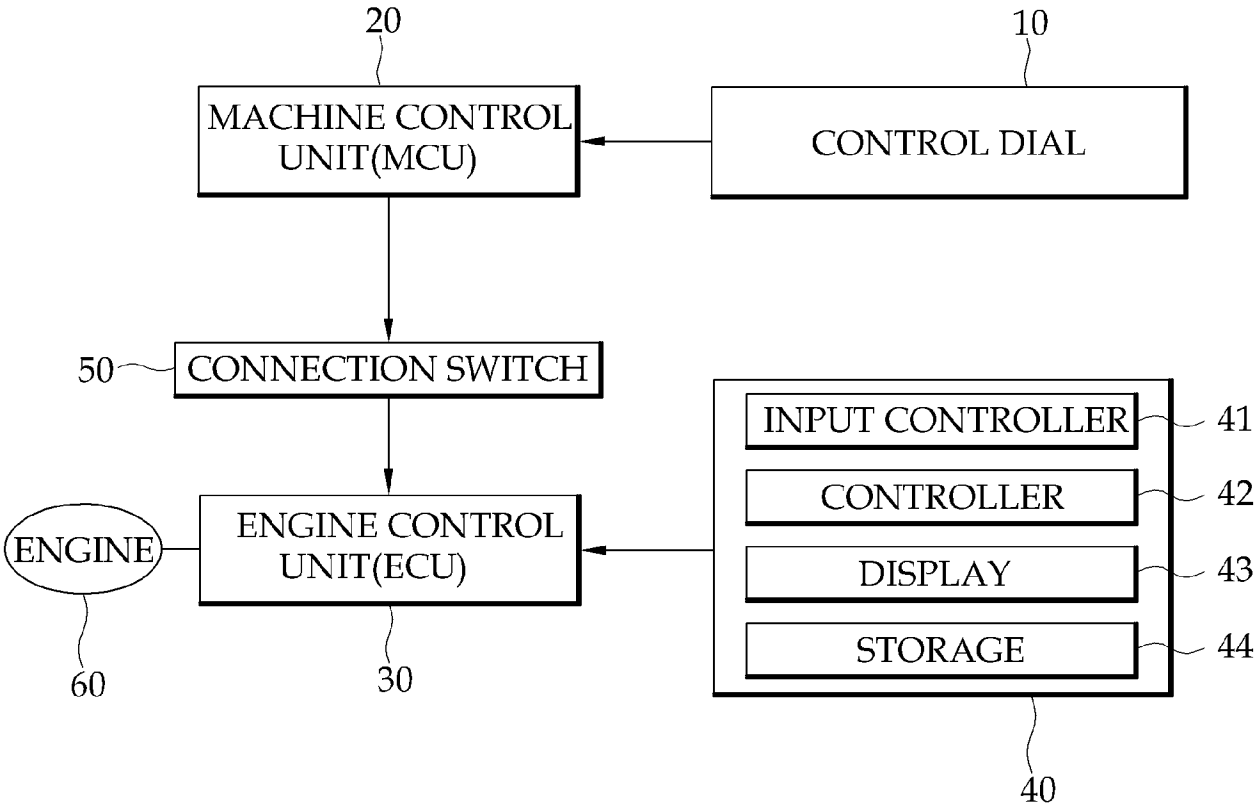
FIG. 5 is a configuration diagram showing an apparatus for contingency controlling an engine rotational speed of a heavy construction equipment according to another exemplary embodiment of the present disclosure.
Figure 6:
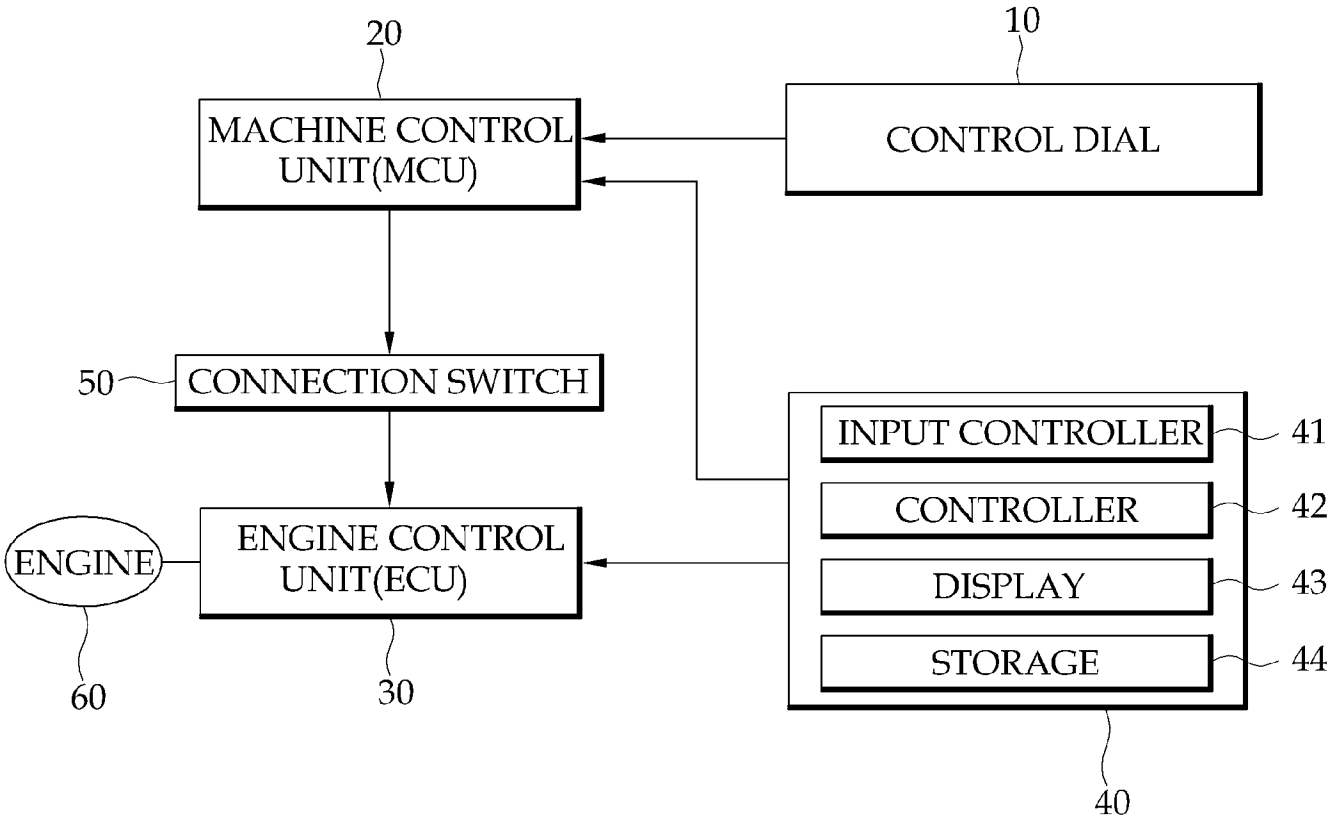
FIG. 6 is a configuration diagram showing an apparatus for contingency controlling an engine rotational speed of a heavy construction equipment according to yet another exemplary embodiment of the present disclosure.

Meanwhile, the present disclosure is not particularly limited to the above-mentioned exemplary embodiment. For example, as shown in FIGS. 5 and 6, the instrument panel 40 may be configured to be connected to the machine control unit 20 and the engine control unit 30 in parallel. In this case, the connection switch 50 may be configured in various types.

Specifically, referring to FIG. 5, the connection switch 50 is installed between the machine control unit 20 and the engine control unit 30 to serve to disconnect the machine control unit 20 and the engine control unit 30 when the machine control unit 20 is erroneous. In this case, the engine control unit 30 can receive control signals from both the machine control unit 20 and the instrument panel 40 and when receiving the signals from both components, the engine control unit 30 is preferably configured to preferentially react to the machine control unit 20.

Further, the machine control unit 20 receives the signals from both the instrument panel 40 and the control dial 10 and although the operator controls any one of the instrument panel 40 and the control dial 10, a signal corresponding thereto can be outputted to the engine control unit 30. In this case, the machine control unit 20 and the engine control unit 30 are controlled to be operated with the controlling device which the operator prefers between the control dial 10 and the instrument panel 40 in a normal state and the engine control unit 30 may be configured to be controlled based on the signal inputted from the device operated most recently.

On the contrary, in a contingency case, the engine rotational speed should be controlled to be adjusted in only the instrument panel 40. Moreover, the machine control unit 20 further includes a function to warn an error through the instrument panel 40 in the contingency and more preferably inform the operator of controlling the engine rotational speed through only the instrument panel 40.

FIG. 6 shows another exemplary embodiment of the present disclosure and is different from the exemplary embodiment of FIG. 5 in that the signal of the instrument panel 40 is inputted into only the engine control unit 30. In this case, since the machine control unit 20 may not judge which signal between the signals inputted from the control dial 10 and the instrument panel 40 is preferential, a load of the machine control unit 20 may be reduced. Meanwhile, the engine control unit 30 should perform the same function as that of the above-mentioned exemplary embodiment.

Figure 7:
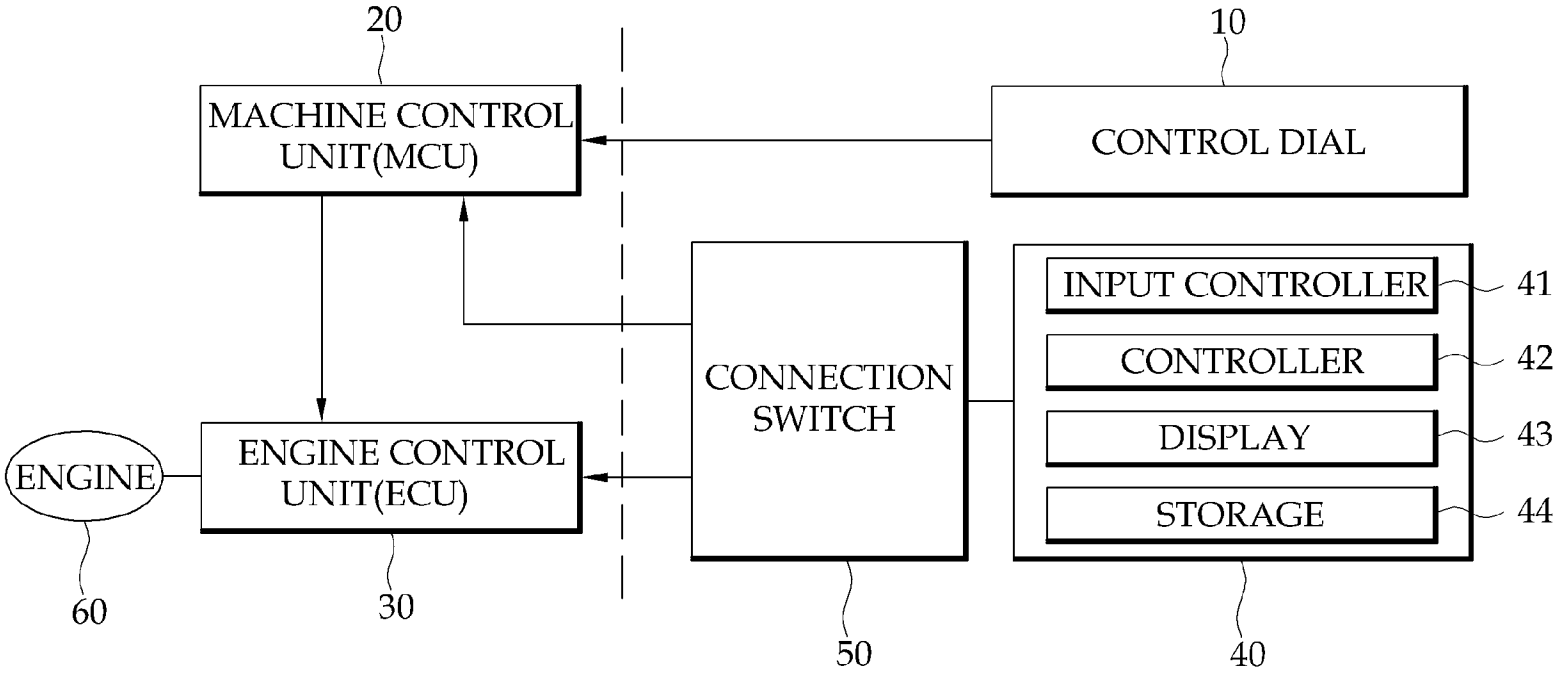
FIG. 7 is a configuration diagram showing an apparatus for contingency controlling an engine rotational speed of a heavy construction equipment according to still yet another exemplary embodiment of the present disclosure.

FIG. 7 shows yet another exemplary embodiment of the present disclosure and unlike the above exemplary embodiments, the signal outputted from the instrument panel 40 is outputted to the machine control unit 20 or the engine control unit 30 by using the connection switch 50. In this case, the connection switch 50 is preferably configured to be switched by automatic or manual operation like the above exemplary embodiments. Accordingly, it can be expected the effect that the loads of the machine control unit 20 and the engine control unit 30 can be reduced as compared with those of the above exemplary embodiments.

Although the exemplary embodiments of the present disclosure have been described with reference to the accompanying drawings, it will be understood to those skilled in the art that the present disclosure can be implemented in other detailed forms without changing the spirit or essential features.

Accordingly, since the above-mentioned exemplary embodiments are provided to inform those skilled in the art of the scope of the present disclosure, it should be understood that they are exemplary in all aspects and not limited and the present disclosure is just defined by the scope of the appended claims.

The present disclosure can be applied to a system for controlling an engine rotational speed of a heavy construction equipment in contingency.

The invention claimed is:

1. An apparatus for contingency controlling an engine rotational speed of a heavy construction equipment, comprising:

a control dial for controlling a rotational speed of an engine;

a machine control unit generating a driving signal to control an operation of the engine by transferring a control value received from the control dial to an engine control unit;

an input controller electrically connected with the engine control unit and allowing an operator to input a desired engine rotational speed; and a connection switch selectively connecting the input controller and the engine control unit when the control dial or the machine control unit does not operate normally.

2. The apparatus for contingency controlling an engine rotational speed of a heavy construction equipment according to claim 1, further comprising an instrument panel, wherein the instrument panel includes, the input controller;

a storage previously storing a control algorithm for the engine rotational speed; and a controller reading a value corresponding to a predetermined control signal from the storage when receiving the predetermined control signal through the input controller, and outputting the read value to the engine control unit.

3. The apparatus for contingency controlling an engine rotational speed of a heavy construction equipment according to claim 1, wherein the engine control unit controls the engine rotational speed through a control signal finally controlled between the control dial and the input controller in a normal state and controls the engine rotational speed only in the input controller after the connection switch is operated, in an abnormal state.

4. The apparatus for contingency controlling an engine rotational speed of a heavy construction equipment according to claim 1, wherein the connection switch automatically connects the input controller and the engine control unit when any one of the machine control unit and the control dial is erroneous.

5. The apparatus for contingency controlling an engine rotational speed of a heavy construction equipment according to claim 1, wherein the connection switch is additionally provided in an instrument panel or an operating room to be switched by operator's selection.

6. The apparatus for contingency controlling an engine rotational speed of a heavy construction equipment according to claim 1, wherein:

the input controller is additionally connected even to the machine control unit, the connection switch is installed between the machine control unit and the engine control unit and disconnects the machine control unit and the engine control unit from each other and connects only the input controller and the engine control unit to each other when the machine control unit and the control dial are erroneous, and the engine control unit is driven based on a signal received from the machine control unit when the engine control unit is connected to both the machine control unit and the input controller and driven based on a signal received from the input controller when the engine control unit is connected with only the input controller.

7. The apparatus for contingency controlling an engine rotational speed of a heavy construction equipment according to claim 6, wherein: the connection switch automatically connects the input controller and the engine control unit when any one of the machine control unit and the control dial is judged to be erroneous.

8. The apparatus for contingency controlling an engine rotational speed of a heavy construction equipment according to claim 6, wherein: the connection switch is additionally provided in an operating room to be switched by operator's selection.

* * * * *